United States Patent [19]

Norton

[11] 4,095,306

[45] Jun. 20, 1978

[54] REACTION LADLE CLEANING MACHINE

[75] Inventor: Ned Gilbert Norton, Myrtle Creek, Oreg.

[73] Assignee: The Hanna Mining Company, Cleveland, Ohio

[21] Appl. No.: 810,012

[22] Filed: Jun. 27, 1977

[51] Int. Cl.[2] ..... B08B 1/00

[52] U.S. Cl. ..... 15/104.07; 15/104.1 C; 173/43; 299/70

[58] Field of Search ..... 15/93 R, 56, 104.1 C, 15/104.07, 246.5; 173/35, 43; 299/69, 70

[56] References Cited

U.S. PATENT DOCUMENTS

| | | | |
|---|---|---|---|
| 3,302,976 | 2/1967 | Grant | 15/104.07 X |
| 3,446,292 | 5/1969 | Stauffer | 173/43 X |
| 3,471,888 | 10/1969 | Grant et al. | 173/43 X |

*Primary Examiner*—Edward L. Roberts
*Attorney, Agent, or Firm*—Maky, Renner, Otto & Boisselle

[57] ABSTRACT

A cleaning machine for removing slag from the interior of a reaction ladle characterized in that the ladle is supported in upright position on a turntable for angular indexing about its vertical axis after each vertical band of slag has been chipped or broken away from the ladle by the tool of a downwardly actuated pneumatic hammer. The hammer is swingably adjustably connected to the tip of a boom which has its upper end swingably adjustably connected to a boom carriage, the carriage being vertically adjustably guided between a pair of columns extending upwardly beyond the upper end of the ladle from a base rearwardly adjacent the turntable. The machine is further characterized in the provision of a control booth above the ladle and laterally adjacent the columns from which the operator has an unobstructed view of the progress of the ladle cleaning operation to facilitate control of the operation of the turntable and the hammer, the swinging of the hammer and the boom, and the vertical positioning of the boom carriage.

15 Claims, 6 Drawing Figures

REACTION LADLE CLEANING MACHINE

BACKGROUND OF THE INVENTION

Machines for removing refractory linings from blast furnace stacks and the like or for removing slag from soaking pits generally comprise a superstructure from which a boom is suspended for swinging about a vertical axis and for pivotal adjustment about a horizontal axis to raise and lower the tip thereof which swingably adjustably carries an air hammer having a moil or chisel point to break up the refractory lining or slag as the case may be. In the case of the lining removing machine, the superstructure is progessively lowered into the blast furnace stack as the lining removal operation progesses and in the case of a soaking pit clean-out machine, the superstructure has tracks which support the boom carrying trolley for longitudinal movement from one end to the other of the soaking pit as the clean-out operation progesses.

As evident, machines of the character indicated must be transported to and set up at the location of the blast furnace stack or soaking pit, and the lining removal or slag clean-out operation is obscured by the superstructure from which the boom and hammer assembly are suspended for swinging about vertical and horizontal axes.

SUMMARY OF THE INVENTION

In contradistinction to known machines of the character indicated, in the reaction ladle cleaning machine herein the ladle is simply lowered upon a turntable in front of the base of a columnar structure which vertically adjustably supports a boom trolley or carriage having an articulated boom-tool assembly arranged so that at each indexed position of the ladle, the tool breaks up a vertical band of slag accumulation from the interior of the ladle.

The machine herein is further characterized in that, laterally adjacent the columnar structure aforesaid and above the upper end of the ladle, it has a heat and sound insulated and air conditioned control booth in which the operator of the machine has unobscured vision of the progress of the cleaning operation because only the slag breaker tool and the tip of the boom is disposed within the ladle even when the cleaning operation has progressed close to the bottom of the ladle.

The machine herein is further characterized in that the boom-tool assembly is counterbalanced so that angular adjustment thereof in a vertical plane may be accomplished by a small diameter, short stroke hydraulic cylinder connected to the boom and carriage at points near the boom pivot axis.

The machine herein is yet further characterized in that the columnar structure provides vertical guides for counterweights which substantially balance the entire weight of the carriage-boom-tool assembly thus to minimize power requirements for raising or lowering the same.

Other objects and advantages will appear from the ensuing description.

DETAILED DESCRIPTION OF A PREFERRED EMBODIMENT

Figure 1:
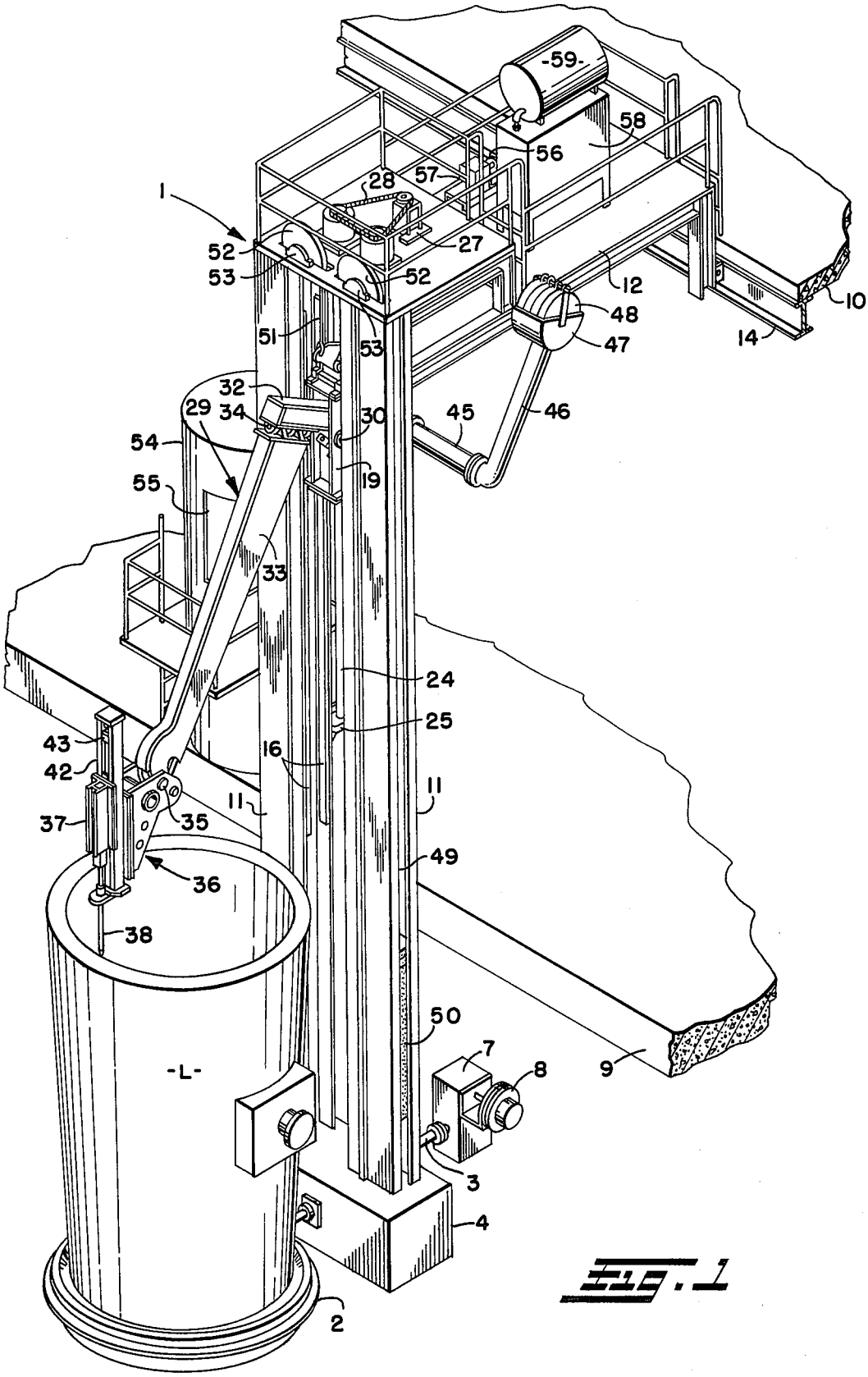
FIG. 1 is a perspective view of a reaction ladle cleaning machine embodying the present invention.

The reaction ladle cleaning machine 1 comprises a turntable 2 upon which the ladle L to be cleaned is placed for angular indexing about its central vertical axis, the turntable 2 being driven by the pinion shaft 3 which extends rearwardly through the base 4 of the machine and having a drive pinion 5 meshing with the ring gear 6 on the turntable 2. The rear end of the pinion shaft 3 is coupled to the output shaft of a gear reducer 7 driven by the reversible air motor 8.

Fixed in the base 4 and extending vertically therefrom above the charging floor 9 and the service floor 10 are a pair of columns 11. Secured to the upper end portions of the columns 11 is a rearwardly extending deck structure 12 which is supported by the service floor supporting beam 14 as shown in FIGS. 1 and 2.

The columns 11 provide parallel tracks 15 and 16 for the upper and lower grooved rollers 17 and the upper and lower cylindrical rollers 18 of a boom carriage or trolley 19. The tracks 15 for the grooved rollers 17 may comprise lengths of steel tubing provided with vertical slots for receiving the eyes of eyebolts 20 which, when inserted through the slots, are turned 90° for clamping of the tracks 15 to the angles 21 by tightening of the nuts 22. (See FIG. 4.)

Suspended from axial and radial thrust bearing assemblies 23 fixed to the deck structure 12 are a pair of ball screws 24 having their lower ends rotatably supported in bearings 25 mounted on brackets of the respective columns 11. The trolley 19 has ball nuts 26 fixed on opposite sides which are operative in well-known manner to vertically move the carriage 19 along tracks 15 and 16 upon rotation of the ball screws 24 as by a reversible hydraulic motor 27 and chain and sprocket drive 28 as clearly shown in FIGS. 1 through 3.

Figure 2:
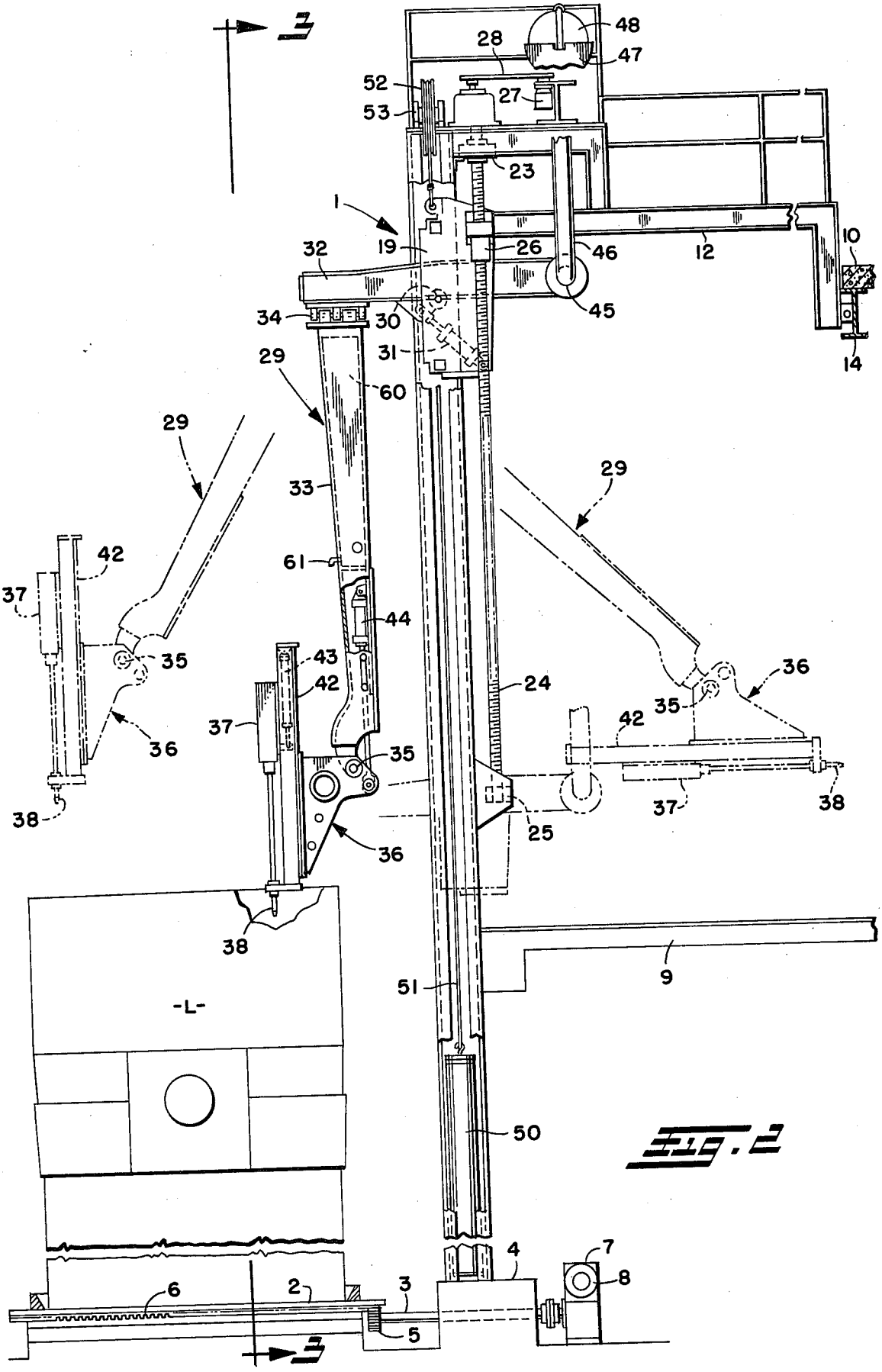
FIG. 2 is a side elevation view as viewed from the right-hand side of FIG. 1, which portions borken away for clarity of illustration of other parts.

A boom 29 is swingably connected to the carriage 19 by the pin 30 to any desired angular position between the phantom line positions shown in FIG. 2, such swinging of the boom 29 being effected as by a double-acting hydraulic cylinder 31 between the carriage 19 and upper leg 32 of the boom. The downwardly extending leg 33 of the boom 29 has a hinge connection 34 with the leg 32 so as to constitute a boom stress relief pivot to relieve side motion of the leg 33 as may be caused by the slag breaking operation or by turntable 2 drift.

Pivotally connected to the tip of the boom 29 at 35 is an air hammer assembly 36 having an air hammer 37 (commonly referred to as a "rock breaker") with a moil or chisel point or like tool 38 which chips or breaks away slag from the interior of the ladle L as the tool 37 is axially advanced and retracted.

Figure 4:
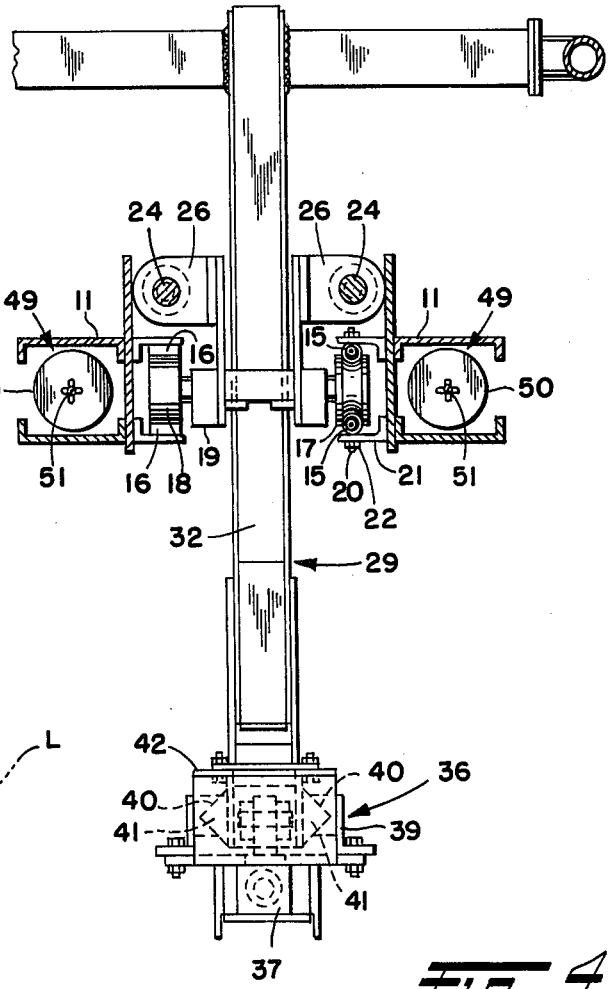
FIG. 4 is a cross-section view on enlarged scale taken substantially along the line 4—4 of FIG. 3.
Figure 5:
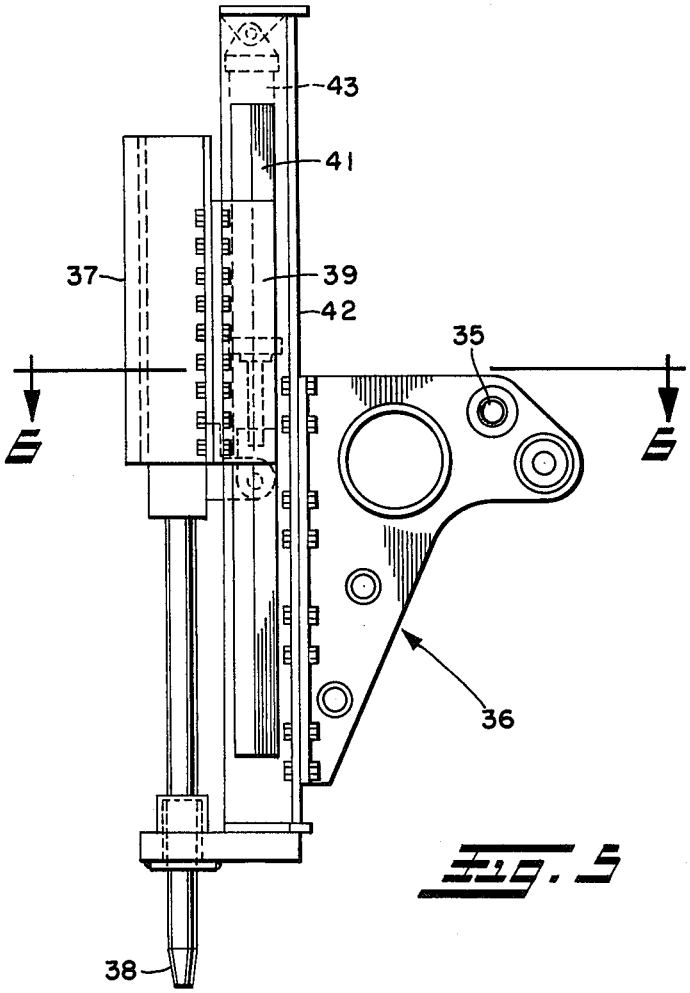
FIG. 5 is a side elevation view of the slag breaker tool which is adapted to be swingably adjustably mounted on the tip of the boom as shown in FIGS. 1 and 2.
Figure 6:
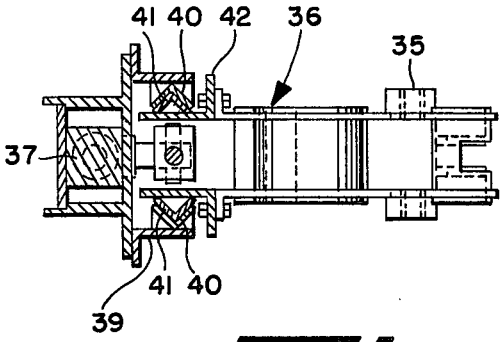
FIG. 6 is a cross-section view of the slag breaker tool taken sustantially along the line 6—6 of FIG. 5.

As best seen in FIGS. 4 through 6, the air hammer 37 is bolted or otherwise secured to a slide member 39 which has grooves 40 engaged with complementary guideways 41 of the head 42 whereby, when the air hammer 37 is operating it may be caused to move downwardly by the pneumatic cylinder 43 to progressively chip away slag along a vertical band in the ladle L. When the pneumatic cylinder 43 reaches the end of its stroke it may be retracted to retract the tool 38 upwardly whereupon the air motor 8 may be operated to angularly index the turntable 2 and ladle L to the next position for removal of the next vertical band of slag from the interior of the ladle L by actuation of the air hammer 37. When all of the slag around the inside of the ladle L has been removed down to a predetermined level as determined by the stroke of the cylinder 43, the boom carriage 19 is lowered by energization of the hydraulic motor 27 to engage the retracted tool 38 with the upper portion of the remaining slag in the ladle L and as each vertical band of slag is removed, the tool 38 is retracted followed by indexing of the turnable 2 and ladle L thereon.

The air hammer assembly 36 is swingably adjusted about pivot 35 by means of a double-acting hydraulic cylinder 44 to provide a desired angle of attack of the tool 38 or to provide pry bar action if necessary.

The upper leg 32 of the boom 29 has a boom-air hammer counterbalancing structure rearward of the boom pivot 30 including a cross arm 45 having upwardly extending arms 46 straddling the deck 12 and provided with weight holders 47 having pockets to receive counterbalancing lead weights 48 which are retained in the pockets as by straps welded to the weight holders 47 and extending through loops in the counterbalancing weights 48. By so counterbalancing the boom-air hammer assembly, the hydraulic cylinder 31 may be of small size connected near the boom pivot 30.

Figure 3:
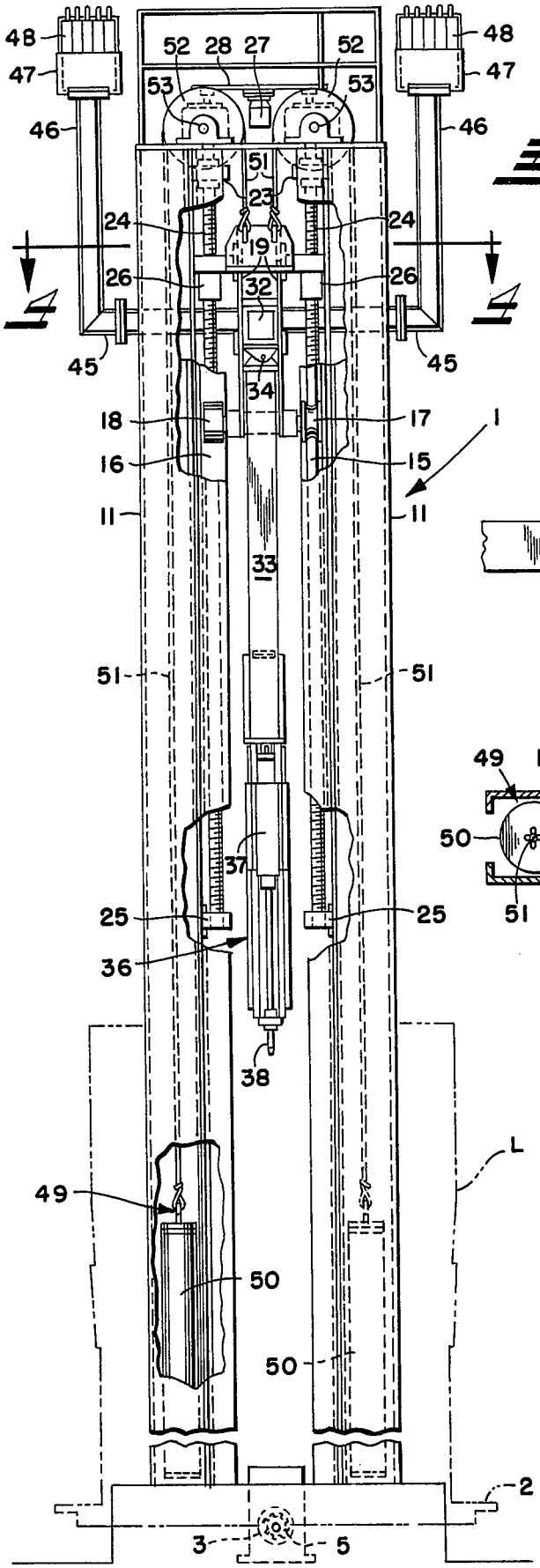
FIG. 3 is a front elevation view as viewed along the line 3—3 of FIG. 2, with portions broken away as shown.

The columns 11, in addition to having vertical tracks 15 and 16 for the boom carriage 19, have guide passages 49 for counterweights 50 which are connected by cables 51 to the upper end of the boom carriage 19 as shown in FIGS. 2 through 4, said cables 51 being trained over sheaves 52 which are supported by bearings 53 on the deck 12. Preferably the counterweights 50 balance the entire weight of the boom carriage 19 and the counterbalanced boom-air hammer assembly so as to minimize the load on the ball screws 24 and to enable the use of a relatively small hydraulic drive motor 27.

Mounted on the charging floor 9 laterally of the columnar portion 11—11 of the machine 1 is a control station or booth 54 which preferably is of heat and sound insulating construction having a shock and heat-resistant viewing window 55 through which an operator seated in the station 54 may readily view the progress of the slag-removing operation from the top of the ladle L all the way down to the boom thereof. Fresh air may be piped into station 54 for operator comfort and such air may be maintained above ambient pressure to exclude dust.

Insofar as the hydraulic system is concerned, the control station 54 will have therein three four-way directional control valves for controlling the operation of the hydraulic motor 27 and the hydraulic cylinders 31 and 44. The lower portion of the deck 12 has thereon the hydraulic power machinery including an electric drive motor 56 for a variable displacement pump 57 and a hydraulic oil reservoir or tank 58 upon which an oil drum 59 is removably supported for periodic filling of the tank 58 to maintain a predetermined level of oil therein. Appropriate conduits (not shown) will be provide to conduct oil under pressure from the pump 57 to the directional control valves aforesaid and to return oil from the directional control valves to the tank 58. The piping between the directional control valve for the hydraulic motor 27 may extend from the control booth 54 upwardly behind the left column 11 as viewed in FIG. 1 to the upper portion of the deck 12 for connection to the ports of the reversible hydraulic motor 27. The piping from the other two directional control valves may extend from within the booth 54 to a manifold on the front of the left column 11 at about a position corresponding to the mid-position of the boom carriage 19 with two pairs of drooped flexible hoses from the manifold to the boom leg 32 and from the boom leg 32 to the ports of the boom swing cylinder 31 and with a pair of drooped flexible hoses from the manifold to fittings at the upper portion of the boom leg 33 for connection by conduits to the ports of the air hammer swing cylinder 44.

Accordingly, an operator within the booth 54 can by selectively operating the three directional control valves effect vertical positioning of the boom-air hammer assembly, effect swinging of the boom 29 about the pivot 30, and effect swinging of the air hammer assembly 36 about the pivot 35 to achieve desired location of the tool 38 for chipping or breaking away of slag from the interior of the reaction ladle L.

As shown in FIG. 2, the boom swing cylinder 31 may be actuated to move the boom-tool assembly rearwardly between the columns 11 whereby a serviceman on the charging floor 9 may readily service or replace the air hammer 37 and/or the tool 38. Moreover, when the boom 29 is thus swung back rearward of the columns 11, the space in front of the columns 11 is cleared so that a ladle L to be cleaned may be readily lowered onto the turntable 2 and similarly the cleaned ladle L may be lifted upwardly as by an overhead crane and transported to the place of use.

Insofar as the pneumatic system is concerned, the main air supply line comes to the upper portion of the deck 12 and an air supply conduit passes behind the left column 11 for connection to a turntable pilot valve within the control station 54 and to a pilot operated valve on the charging floor 9 which has conduits extending therefrom behind the left column 11 for connection to the ports of the reversible air motor 8. The air supply line also is connected to a rock breaker pilot valve in the booth 54 from which conduits extend behind the left column 11 to rock breaker control valves on the upper portion of the deck 12. From these valves air lines are connected to the manifold aforesaid and flexible hoses are drooped from the manifold to the upper portion of the boom leg 33 and from the lower portion of the boom leg 33 to the air hammer 37 and to the pneumatic cylinder 43. The boom leg 33 has an airtight chamber 60 therein to constitute an air pressure tank for the air hammer 37. A drain valve 61 is provided at the lower end of the chamber 60 for draining of accumulated liquid therefrom. The rock breaker pilot valve and control valves are preferably arranged so that the air hammer 37 is operated only when the tool 38 is advanced in a downward direction by pneumatic cylinder 43.

The embodiments of the invention is which an exclusive property or privilege is claimed are defined as follows:

1. A machine for breaking away slag accumulation from the interior or a reaction ladle comprising a columnar structure having an upper portion extending beyond the upper end of the ladle; and slag breaker means including a carriage vertically adjustable along said upper portion, a downwardly extending boom having its upper end swingably adjustably connected to said carriage, and a slag breaking tool assembly swingably adjustably connected to the lower end of said boom and having a power actuated tool for engagement with slag on the interior of the ladle.

2. The machine of claim 1 wherein said machine has power drive means adapted to be selectively energized to raise or lower said carriage, to change the downward inclination of said boom, and to change the angle of the power actuated tool with respect to the boom; and wherein said machine has an elevated control booth laterally adjacent said columnar structure and above the upper end of the ladle from which an operator of said machine has an unobstructed view of the progress of the ladle cleaning operation and from which he may control the operation of said power drive means and said power actuated tool.

3. The machine of claim 1 wherein said columnar structure comprises a pair of columns between which said carriage is guided for vertical adjustment.

4. The machine of claim 1 wherein said upper portion has vertically disposed power driven screw means engaged with nut means on said carriage operative when energized to vertically adjust said carriage and hence to vertically adjust the position of said power actuated tool with respect to the ladle.

5. The machine of claim 1 wherein fluid cylinders between said carriage and said boom and between said boom and said tool assembly are respectively operative to swingably adjust said boom and to swingably adjust said tool assembly so that said power actuated tool is positioned for breaking away slag from the interior of the ladle.

6. The machine of claim 1 wherein said columnar structure comprises a pair of columns; and wherein said boom is swingably adjustable rearwardly between said columns to facilitate servicing or replacement of said power actuated tool.

7. The machine of claim 1 wherein said tool assembly comprises a tool head swingably adjustably connected to the lower end of said boom, an air hammer to impart longitudinal vibration to said tool, said air hammer being longitudinally slidable on said head, and a fluid cylinder carried by said head and operatively connected to said hammer to longitudinally advance or retract the latter.

8. The machine of claim 1 wherein said boom has counterbalancing means to substantially balance the weight of said boom and said tool assembly about the axis of the swinging connection of said boom to said carriage.

9. The machine of claim 1 wherein counterweights are vertically movably guided by said columnar structure and are operatively connected to said carriage by cables trained over sheaves at the upper end of said structure; said counterweights substantially balancing the weight of said slag breaker means.

10. The machine of claim 1 further comprising a turntable laterally adjacent said columnar structure on which a ladle to be cleaned is adapted to be supported in upright position for angular indexing about its vertical axis, said slag breaking tool assembly being operative to break away successive vertical bands of slag from the interior of the ladle at successive indexed positions of said turntable and ladle thereon.

11. The machine of claim 10 wherein a fluid pressure operated motor is operatively connected to said turntable; and wherein said control booth is adapted to contain control valve means for operation by the operator in said booth to effect angular indexing of said turntable and the ladle supported thereon.

12. The machine of claim 1 wherein said boom has an upper transverse leg which is swingably adjustably connected to said carriage and a downwardly extending elongated leg to which said tool assembly is swingably adjustably connected; and wherein pivot means connects said legs together to relieve said boom of stress due to side load on said power actuated tool.

13. The machine of claim 12 wherein said transverse leg is swingably adjustably connected to said carriage between its ends, said pivot means being at one end; and wherein the other end of said transverse leg has counterbalancing means to substantially balance the weight of said boom and said tool assembly.

14. The machine of claim 1 wherein said columnar structure has a deck at its upper end on which is supported hydraulic power equipment including a pump and a tank, and a reversible hydraulic motor for driving vertical screw means axially fixed on said deck and having engagement with nut means on said carriage thus to vertically adjust the latter; wherein hydraulic cylinders between said carriage and said boom and between said boom and said tool assembly are respectively operative to swingably adjust said boom with respect to said carriage and to swingably adjust said tool assembly with respect to said boom; and wherein a control booth laterally adjacent to said columnar structure and above the upper end of the ladle is adapted to contain directional control valves for selective operation by an operator within said booth to actuate said hydraulic motor and said hydraulic cylinders while the operator has unobstructed view of the progress of the ladle cleaning operation.

15. The machine of claim 14 further comprising a turntable on which a ladle to be cleaned is adapted to be supported in upright position laterally adjacent said columnar structure for angular indexing about its vertical axis, and a fluid pressure operated motor operatively connected to said turntable and ladle thereon, said booth being adapted to contain control valve means for operation by an operator in said booth to effect angular indexing of said turntable and the ladle supported theron for breaking away successive vertical bands of slag at successive indexed positions of said turntable and ladle thereon by said slag breaking tool assembly.

* * * * *